US009105389B2

(12) United States Patent
Bockholt et al.

(10) Patent No.: US 9,105,389 B2
(45) Date of Patent: Aug. 11, 2015

(54) COOLING SYSTEM FOR DRY TRANSFORMERS

(71) Applicant: ABB TECHNOLOGY AG, Zürich (CH)

(72) Inventors: Marcos Bockholt, Paderborn (DE); Frank Cornelius, Olsberg (DE); Jens Tepper, Brilon (DE); Burak Esenlik, Paderborn (DE); Bhavesch Patel, Brilon (DE); Benjamin Weber, Winterberg (DE); Arthouros Iordanidis, Baden (CH); Jasmin Smajic, Schöfflisdorf (CH); Thorsten Steinmetz, Baden-Dättwil (CH); Bernardo Galletti, Nussbaumen bei Baden (CH)

(73) Assignee: ABB TECHNOLOGY AG, Zurich (CH)

( * ) Notice: Subject to any disclaimer, the term of this patent is extended or adjusted under 35 U.S.C. 154(b) by 0 days.

(21) Appl. No.: 13/941,197

(22) Filed: Jul. 12, 2013

(65) Prior Publication Data

US 2013/0300526 A1 Nov. 14, 2013

Related U.S. Application Data

(63) Continuation of application No. PCT/EP2012/000209, filed on Jan. 18, 2012.

(30) Foreign Application Priority Data

Feb. 16, 2011 (EP) ..... 11001245

(51) Int. Cl.
*H01F 27/08* (2006.01)
*H01F 27/28* (2006.01)
(Continued)

(52) U.S. Cl.
CPC ..... *H01F 27/085* (2013.01); *H01F 27/2876* (2013.01); *H01F 30/12* (2013.01); *H01F 2027/328* (2013.01)

(58) Field of Classification Search
CPC ... H01F 27/085; H01F 27/2876; H01F 27/08; H01F 2027/328; H01F 30/12
USPC ..... 336/60, 5, 184, 170, 145, 182, 214, 215
See application file for complete search history.

(56) References Cited

U.S. PATENT DOCUMENTS 2,229,373 A * 1/1941 Cole ..... 336/84 R
2,855,576 A * 10/1958 Rohatyn ..... 336/182
(Continued)

FOREIGN PATENT DOCUMENTS

DE 40 29 097 A1 3/1992
DE 20 2009 003845 U1 6/2009
(Continued)

OTHER PUBLICATIONS

International Search Report (PCT/ISA/210) issued on "Date ISR issued", by the Patent Office as the International Searching Authority for International Application No. PCT/EP2012/000209.

*Primary Examiner* — Mangtin Lian
(74) *Attorney, Agent, or Firm* — Buchanan Ingersoll & Rooney PC

(57) ABSTRACT

The disclosure is related to a dry transformer, which includes a transformer core with at least two parallel limbs and upper and lower yokes, and at least two hollow cylindrical coils, each arranged as neighbored coils around a limb of the at least two parallel limbs. A cooling system can include at least one wall-like diaphragm in-between the neighbored coils, which is in parallel to the orientation of the limbs.

19 Claims, 2 Drawing Sheets

40

(51) Int. Cl.

| | |
|---|---|
| ***H01F 30/02*** | (2006.01) |
| *H01F 30/12* | (2006.01) |
| *H01F 27/32* | (2006.01) |

(56) References Cited

U.S. PATENT DOCUMENTS

| | | | | | |
|---|---|---|---|---|---|
| 3,200,357 | A | * | 8/1965 | Olsen et al. | 336/205 |
| 3,810,058 | A | * | 5/1974 | White et al. | 336/196 |
| 6,144,282 | A | | 11/2000 | Lee | |
| 6,160,464 | A | | 12/2000 | Clarke et al. | |
| 2009/0045898 | A1 | | 2/2009 | MacLennan | |
| 2010/0164665 | A1 | | 7/2010 | Sevakivi | |
| 2010/0194515 | A1 | * | 8/2010 | Hurst et al. | 336/212 |

FOREIGN PATENT DOCUMENTS

| | | | |
|---|---|---|---|
| EP | 1 056 101 | A2 | 11/2000 |
| GB | 187 921 | A | 11/1922 |
| GB | 382 002 | A | 10/1932 |
| WO | WO 98/34238 | A1 | 8/1998 |
| WO | WO 99/17309 | A2 | 4/1999 |
| WO | WO 2004/112064 | A1 | 12/2004 |

* cited by examiner

COOLING SYSTEM FOR DRY TRANSFORMERS

RELATED APPLICATION(S)

This application claims priority as a continuation application under 35 U.S.C. §120 to PCT/EP2012/000209, which was filed as an International Application on Jan. 18, 2012 designating the U.S., and which claims priority to European Application 11001245.7 filed in Europe on Feb. 16, 2011. The entire contents of these applications are hereby incorporated by reference in their entireties.

FIELD

The disclosure relates to a dry transformer.

BACKGROUND INFORMATION

Known dry transformers are used, for example, in electrical power distribution systems or in local power systems, such as, in marine applications. Dry power transformers can be available within voltage levels, for example, between 1 kV and 60 kV with a rated power in-between 100 kVA and several MVA. Dry transformers can reduce the use of oil as an insulation and cooling medium, can have reduced maintenance, lessen the fire load, and can provide for higher environmental friendliness. However, where no liquid cooling medium is used to circulate around the transformer coils, cooling can be needed. Due to electrical losses during operation of a transformer, for example, the transformer coils can be a heat source for heat energy.

The insulation material of a transformer coil can be characterized by a rated temperature, for example, 150° C. If this temperature is exceeded, a loss of the insulation ability might be the consequence. Also the electric conductor of the transformer coil, which is made, for example, out of copper or aluminium, should not exceed a certain limit. The electric resistance of the conductor can rise with increasing temperature and the electrical losses therewith. Therefore, a temperature distribution within the transformer coil, which can be homogenous and avoid punctual stress, can be desirable.

SUMMARY

A dry transformer is disclosed, comprising: a transformer core with at least two parallel limbs and upper and lower yokes; at least two hollow cylindrical coils, each arranged as neighbored coils around a limb of the at least two parallel limbs; and a cooling system having at least one wall-like diaphragm in-between the neighbored coils which are configured in parallel to an orientation of the at least two parallel limbs; wherein the at least two parallel limbs are arranged polygonally around a virtual center axis parallel thereto.

BRIEF DESCRIPTION OF THE DRAWINGS

The disclosure is explained below with reference to exemplary embodiments shown in the drawings. In the drawings.

DETAILED DESCRIPTION

Figure 1:
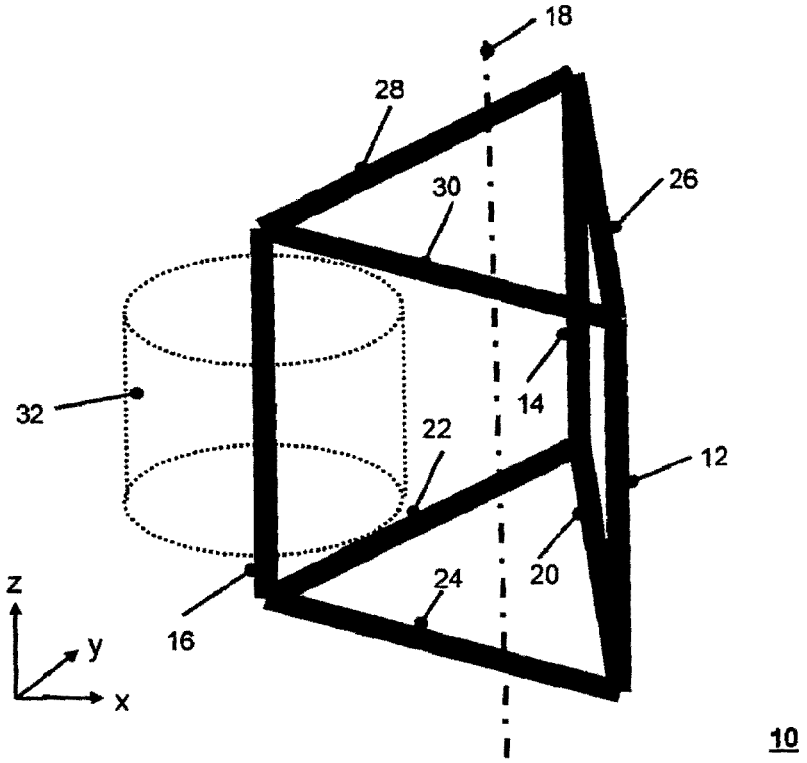
FIG. 1 shows an exemplary triangular transformer core.

A means for cooling the coils of an electrical transformer is disclosed, which can provide a reduced and homogeneous temperature distribution within the transformer coils when the transformer is in operation. A transformer can include three coils, which are arranged in parallel on limbs of a transformer core, which can be arranged perpendicular along a linear yoke. During operation of such a transformer, the inner coil, which is neighbored on two sides of the other two coils, can have a higher temperature than the other coils because heat radiation can be applied from those neighbored coils thereon. Because transformer coils can be identical for constructional reasons, neither a homogeneous temperature distribution in-between the three coils nor a homogeneous temperature distribution within the coils themselves may be gained.

In accordance with an exemplary embodiment, a temperature distribution can be achieved within an arrangement of transformer coils in a polygonal respectively triangular manner. In accordance with an exemplary embodiment, each coil applies heat radiation on the other coils, which can be increased once more, for example, in the axial center area of such a transformer. Due to a more or less rotation symmetrical arrangement of the coils in a triangular manner the heat distributions in-between the coils can be comparable, wherein the temperature distribution within the coils themselves can become less non-homogeneous. During operation of such a transformer, the parts of the coils within the axial center area can have a higher temperature than those outside parts with no applied heat radiation from neighbored coils.

The disclosure relates to a dry transformer, which includes a transformer core with at least two parallel limbs, upper and lower yokes and at least two hollow cylindrical coils, each arranged around a limb.

In accordance with an exemplary embodiment, a dry transformer is disclosed, which includes a cooling system having at least one wall-like diaphragm in-between neighbored coils which is in parallel to the orientation of the limbs.

The wall-like diaphragm can have a height, for example, which corresponds to at least the axial height of the coils, and which can prevent on the one side heat radiation in-between neighbored coils. For example, heat radiation can be applied on the diaphragms so that their temperature will rise. In accordance with an exemplary embodiment, the transformer can be oriented in that way, as well as the coils of the diaphragms can be oriented vertically. The diaphragm can form a guide plate for an additional natural air flow from bottom to top through the transformer. This airflow can reduce the temperature within the area of neighbored coils. To increase this effect, the surface of the diaphragm can have a heat-absorbing color, such as black, for example. Furthermore, the diaphragm can be made from a material, which provides a good heat conductivity, such that the diaphragm acts additionally as cooling element, which transfers heat from the area in-between two neighbored coils to an area outside. In this case the diaphragm can be elongated over the area, where heat radiation is applied from the coils, such that heat of the diaphragm dissipates from the elongated areas to a heat sink within the environment. Thus, the cooling of a transformer respectively its coils can be improved.

In an exemplary embodiment of the disclosure, the parallel limbs can be arranged polygonal around a virtual center axis parallel thereto. The virtual center axis can be located within the axial center area of the transformer. Such arrangement can provide on one side the design of the transformer, but on the other side a kind of hot spot is built in the axial center area. For example, the diaphragms in-between neighbored coils can be elongated in direction of the virtual center axis, so that a star-like arrangement of the diaphragms can be provided. Thus, an improved cooling effect within the temperature critical axial center area can be gained, wherein no additional space is used for such a cooling system.

In an exemplary embodiment of the disclosure, the parallel limbs can be arranged triangular, wherein three coils are used, which can be used for transformers in three phase networks. The arrangement can be comparable to those mentioned above, wherein, for example, an equilateral triangle is disclosed. Hence, symmetry of the arrangement (angle 120°) can be gained and the temperature distribution in-between all three coils can be comparable.

In an exemplary embodiment of the disclosure, the diaphragms can be connected in the region around the virtual center axis so that a star-like cooling module can be built. Such a star-like cooling module can be relatively easy to pre-assemble so that the effort for assembling or maintaining such a transformer can be reduced. Furthermore the single diaphragms can be thermally connected, such that, in case of an inhomogeneous load respectively heat generation of the different coils, and a more homogenous temperature distribution within the transformer can be gained.

According to an exemplary embodiment of the disclosure, the star-like cooling module can include a chimney around the virtual center axis, which can be used as inner cooling channel. Thus, the interaction surface of the cooling module on one side can provide for increased thermal interaction. Furthermore, the natural air flow, for example, cold air from the bottom can be heated and rising up due to a reduced density, which can be improved by such a chimney.

According to an exemplary embodiment of the disclosure, means can be provided for an improved heat transfer from the chimney to a heat sink. For example, a blower or other similar device, which increases the airspeed through the chimney, can be used as a means for heat transfer. Optionally, for example, such a blower can include regulation functionality controlling the blower speed dependent on the actual temperature of inner parts of the transformer and the environmental temperature. Other means for heat transfer, for example, heat pipes and/or heat exchangers can also be used to improve heat transfer within the chimney.

According to the disclosure, at least one evaporator of a heat pipe in a thermoconducting connection with at least one of the diaphragms can be provided. For example, the diaphragms can be made of a material with good thermoconducting characteristics, so that the heat transfer away from the diaphragms can be provided.

According to an exemplary embodiment, ribs and/or fins can be on the surface of the diaphragms, for example, in vertical orientation, such that an airflow from bottom to top of the transformer, respectively, such that the diaphragm is not blocked or reduced. In accordance with an exemplary embodiment, the ribs or fins can increase the interaction surface in-between diaphragm and air, such that an improved cooling effect can be gained.

According to an exemplary embodiment, the diaphragms can have a convex shape, which is adapted to the outer shape of the adjacent coils. Thus, the radial distance in-between surface of the coil and surface of the belonging convex diaphragm can be more or less equal, such that the heat radiation from the coil to the convex diaphragm can be about homogenous. The temperature distribution within the convex diaphragm can also be homogenous so that the heat transfer can be improved once again. In an exemplary embodiment, three convex diaphragms can be building a star like cooling module with chimney inside. In an exemplary embodiment, a relatively rather high cross section of the chimney can be provided on one side, wherein the thermal radiation of all three coils can be applied homogenously on the surface of the diaphragms.

According to an exemplary embodiment, the cooling modules of the diaphragms can be made at least in part from a metal. Metals such as aluminium, copper or steel, for example, can have relatively good thermal conductivity. In accordance with an exemplary embodiment, the diaphragms are not only intended to be used as guiding plate for airflow, but also as a cooling element.

According to an exemplary embodiment, the cooling modules of the diaphragms can be made at least in part from a dielectric material. In accordance with an exemplary embodiment, a dielectric material can be an electrical insulator that can be polarized by an applied electric field. When a dielectric is placed in an electric field, electric charges do not flow through the material, as in a conductor, but only slightly shift from their average equilibrium positions causing dielectric polarization. Thus, the use of a dielectric material can be useful to influence the distribution of electric potential in-between the coils in an asymmetric arrangement.

According to an exemplary embodiment, the cooling module of at least one diaphragm can be thermoconducting and connected with at least one part of the transformer core. Since the temperature of the transformer core, which can be made from stacked metal sheets, the transformer core itself can be used as cooling element. Thus, the cooling module of the diaphragm can be made from a heat conducting material such as a metal, wherein the heat energy applied thereon is transferred partly over the thermoconducting connection into the transformer core. The additional surface of the transformer core can be suitable to thermally interact with the environment respectively the surrounding air, so that an additional cooling effect can be gained.

In an exemplary embodiment, the thermoconducting connection can include slitted sleeves surrounding a yoke of the transformer core. The sleeves themselves can be connected with a diaphragm of the cooling system, which, for example, can be elongated over the axial height of the coil, so that the belonging yoke is arranged through the diaphragm. Thus a relatively good thermal conductivity in-between diaphragm and yoke can be gained. For example, the induction of a voltage in a closed conductor loop around the yoke can be avoided. Thus, the sleeves can be slitted along their axial direction as the diaphragm surrounding the yoke, if an electric conducting material is used. Due to stability reasons the relevant slits might be filled with an insulating material, such as epoxy glue.

According to an exemplary embodiment of the disclosure the thermoconducting connection can include at least one thermoconducting strap which ends into a stacked part of the transformer core. Thus, heat energy of the diaphragm can be directly applied into the transformer core which can be used as additional cooling element.

FIG. 1 shows an exemplary schematic triangular transformer core 10 in a three dimensional view. Around a vertical virtual center axis 18 three transformer limbs 12, 14, 16 can be arranged in a triangular shape in parallel to the virtual center axis 18. The vertical orientation of the transformer core respectively the limbs 12, 14, 16 as shown in FIG. 1 corresponds to the orientation of a transformer. Three horizontal lower yokes 20, 22, 24 and three horizontal upper yokes 26, 28, 30 can be arranged in the same triangular shape and can be connected with the limbs 12, 14, 16. Thus, the magnetic loops of the three limbs 12, 14, 16 can be closed over the yokes 20, 22, 24, 26, 28, 30 also in this triangular core shape. The limbs and yokes can be indicated schematically by black lines, and wherein a transformer core has a cross section for the conduction of the magnetic flux. Thus, the transformer core includes, for example, a larger number of stacked metal sheets which can be arranged in a loop structure. The cross section of a limb or yoke can be, for example, something in-between round and rectangular.

As shown in FIG. 1, a coil 32 can be indicated as dotted cylinder around the limb 16, and wherein a coil 32 for each of the three limbs 12, 14, 16 is used, for a three phase transformer. Each hollow-cylindrical coil 32 can include a low-voltage winding, which can be arranged, for example, in the radial inner area of the hollow-cylinder coil 32. In the radial outer area of the coil 32, a high-voltage winding can be used. The low voltage windings can be electrically connected as well as the high voltage windings. Cooling channels which extend in axial direction through the coils 32 can also be used. The height of a diaphragm, which is not shown in FIG. 1, can be, for example, at least as high as the height of the coil 32, which can help prevent heat radiation in-between neighbored coils 32.

Figure 2:
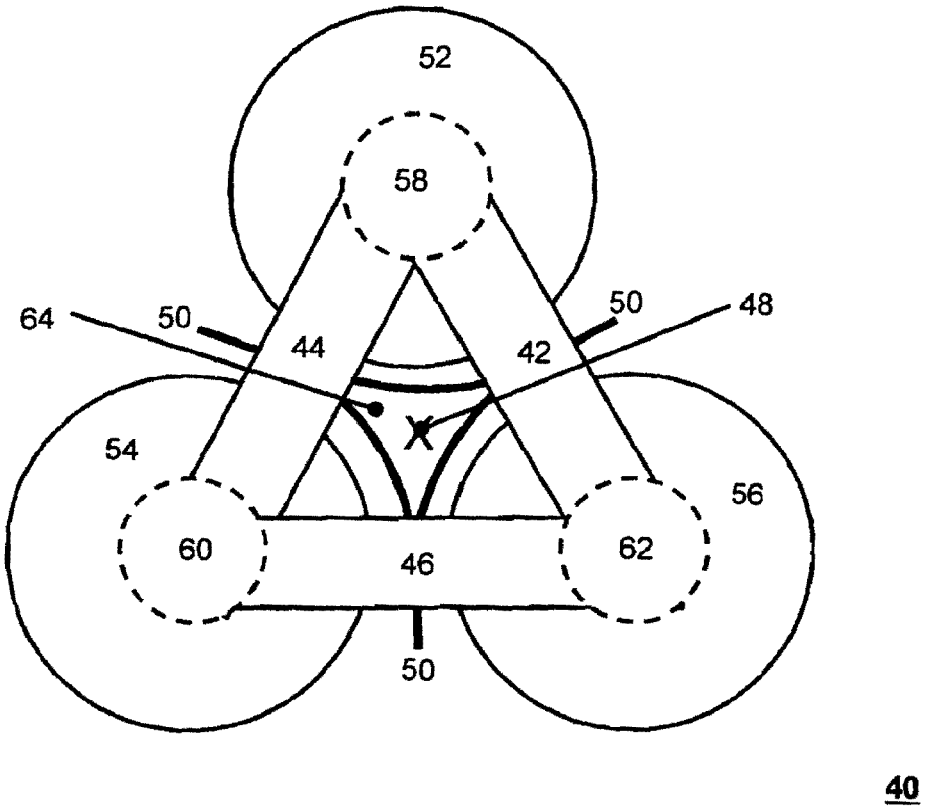
FIG. 2 shows an exemplary triangular dry transformer with cooling system.

FIG. 2 shows an exemplary triangular dry transformer with a cooling system from a top view 40. Visible parts of the transformer core from this top view are three yokes 42, 44, 46, which can be arranged in an equilateral triangular shape. Limbs 58, 60, 62, which can be perpendicular to the yokes, are indicated with dotted circles. Around limbs 58, 60, 62, coils 52, 54, 56 can be arranged. The equilateral triangular shape can provide a homogenous heat distribution in-between the coils 52, 54, 56. The heat distribution within a coil 52, 54, 56 can be in principal not homogenous, since the radial inner area of the transformer, which can be located around the virtual axis 48, is an area with increased temperature due to the thermal radiation in-between the coils 52, 54, 56. A first cooling module 50, comprising (e.g., consisting of) three convex shaped diaphragms, can be arranged around the virtual axis 48 in-between the adjacent coils 52, 54, 56.

In accordance with an exemplary embodiment, the shape of the cooling module can provide that the distance from the radial outer surface of the coils 52, 54, 56 to the surface of the diaphragms of the first cooling module 50 can be more or less the same so that heat radiation is applied homogenously on the cooling module from the coils. The inner space of the cooling module 50 can be a chimney 64, which can be formed by the inner sides of the convex diaphragms. This chimney 64 can be suitable as a cooling channel for a natural air flow from its bottom to its top. In accordance with an exemplary embodiment, to help with the cooling effect, for example, by a blower, which can increase the amount of air from the environment flowing through the chimney. In accordance with an exemplary embodiment, for example, cooled air can be fed through the chimney 64 to help increase the cooling effect.

Figure 3:
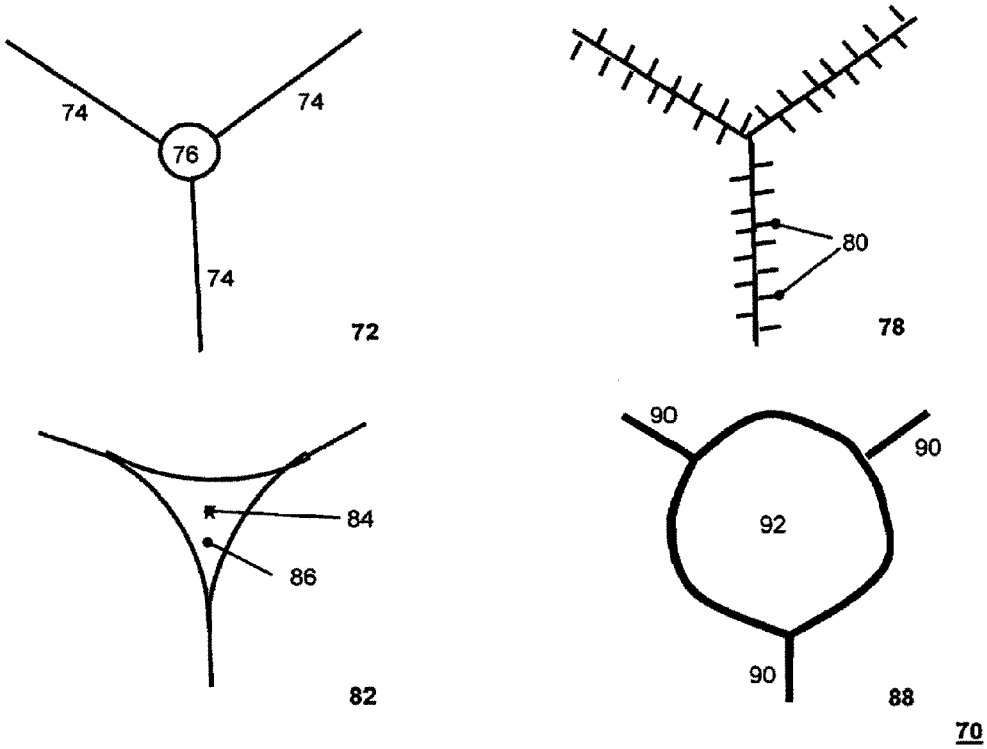
FIG. 3 shows several exemplary cooling modules.

FIG. 3 shows exemplary cooling modules in an overview sketch 70. For example, an exemplary embodiment cooling module 72 can be a star like cooling module with plane diaphragms 74, which can be symmetrically arranged around a chimney 76. In accordance with an exemplary cool module 80, the cooling module 80 does not include a chimney for improved cooling, but several cooling ribs 80 on the surface of the diaphragms. In accordance with an exemplary embodiment, the ribs shown in the exemplary embodiment 78 can be combined with all other exemplary embodiments 72, 82, 88. The orientation of the ribs 80 can be, for example, vertical, so that airflow from the bottom to the top of the transformer is not prohibited by crosswise arranged ribs 80. An exemplary cooling module 82 shows a cooling module build from three convex diaphragms which can be arranged around a virtual center axis 84. The convex shape of the diaphragms can be adapted to the outer shape of belonging transformer coils, which are not shown in this figure. An exemplary cooling module 88 corresponds in principal to the exemplary embodiment 72, wherein a chimney 92 with a larger diameter and wherein the diaphragms 90 can be radially shortened. In accordance with an exemplary embodiment, the higher diameter of the chimney 92 compared to the exemplary embodiment 72 can have the effect, that the distance in-between the outer surface of adjacent coils and the chimney 92 can varying, so that radiation from the coil is not partly reflected back to the coil by the chimney 92 but radiates into the outer environment in a higher share.

Figure 4:
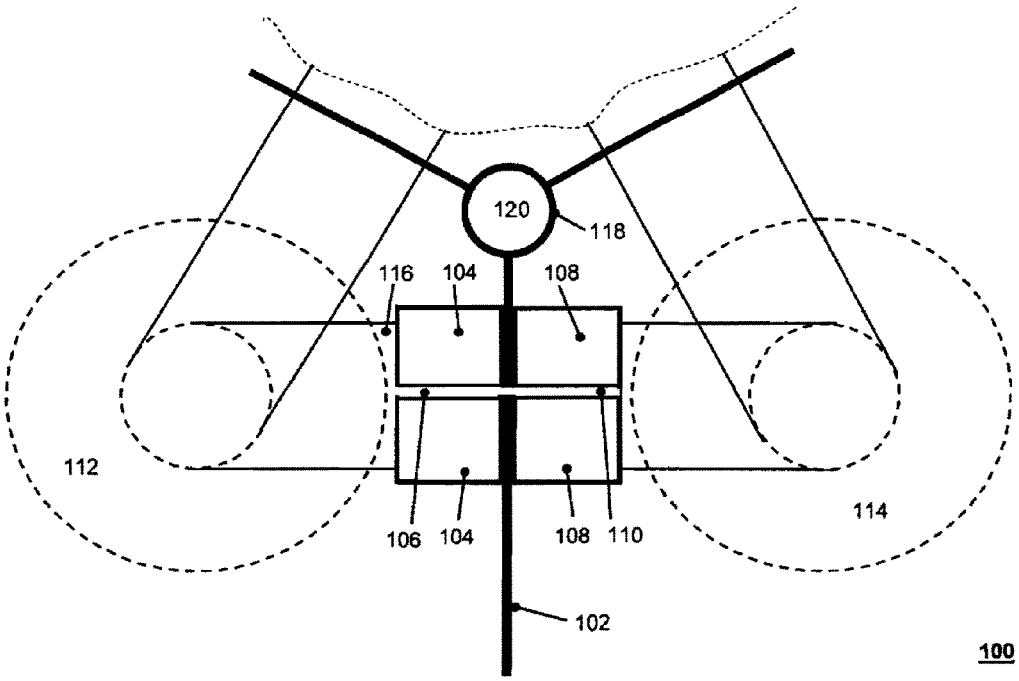
FIG. 4 shows a section of an exemplary transformer with cooling system.

FIG. 4 shows a section of an exemplary transformer with cooling system in a top view 100. A yoke 116 can be arranged on top in-between two limbs, where hollow cylindrical coils 112 and 114 are arranged. A cooling module 118 with a chimney 120 can be arranged within the axial center area of the transformer. A diaphragm 102 of the cooling module 118 can be elongated in the direction of the not shown virtual center axis, so that the yoke 116 passes through a hole, which can be within the diaphragm 102. In accordance with an exemplary embodiment, for improved heat conductibility of the diaphragm, for example, the diaphragm can be made from a metal. Thus at least one slit within the diaphragm can be used to interrupt any closed conductive loop around the yoke 116. Otherwise, a voltage may become induced during operation of the transformer so that an undesirable current would flow along the loop.

The diaphragm 102 can also be heated during operation of the transformer by the coils 112 and 114, and sleeves 104 and 108, which surround a section of the yoke 116. The sleeves 104, 108 can be made from a thermoconducting material, such as a metal. The sleeves 104, 108 can also be provided with a slit 106, 110 to electrically interrupt a conducting loop around the yoke 116.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SIGNS

10 exemplary triangular transformer core
12 first limb of exemplary triangular transformer core
14 second limb of exemplary triangular transformer core
16 third limb of exemplary triangular transformer core
18 virtual center axis of exemplary triangular transformer core
20 first lower yoke of exemplary triangular transformer core
22 second lower yoke of exemplary triangular transformer core
24 third lower yoke of exemplary triangular transformer core
26 first upper yoke of exemplary triangular transformer core
28 second upper yoke of exemplary triangular transformer core
30 third upper yoke of exemplary triangular transformer core
32 hollow cylindrical coil arranged around third limb
40 exemplary triangular dry transformer with cooling system
42 first upper yoke
44 second upper yoke
46 third upper yoke

48 virtual axis
50 first cooling module
52 first coil
54 second coil
56 third coil
58 first limb
60 second limb
62 third limb
64 first chimney
70 several exemplary cooling modules
72 exemplary cooling module
74 wall-like diaphragm of an exemplary cooling module
76 second chimney
78 exemplary cooling module
80 fins/ribs
82 exemplary cooling module
84 virtual axis
86 second chimney
88 exemplary cooling module
90 wall-like diaphragm of exemplary cooling module
92 third chimney
100 section of a transformer with cooling system
102 elongated wall-like diaphragm
104 first sleeve
106 first slit
108 second sleeve
110 second slit
112 fourth coil
114 fifth coil
116 yoke partly surrounded by sleeves
118 cooling module
120 fourth chimney

What is claimed is:

1. Dry transformer, comprising:

a transformer core with at least three parallel limbs and upper and lower yokes;

at least three hollow cylindrical coils, each arranged as neighbored coils around a limb of the at least three parallel limbs;

a cooling system having at least one wall-like diaphragm in-between the neighbored coils which are configured in parallel to an orientation of the at least three parallel limbs;

wherein the at least three parallel limbs are arranged polygonally around a virtual center axis parallel thereto; and wherein the diaphragms are connected in a region around the virtual center axis forming a star-like cooling module, and wherein the star-like cooling module comprises:

a chimney around the virtual center axis, which forms an inner cooling channel.

2. Dry transformer according to claim 1, wherein the at least three parallel limbs are three limbs configured in a triangular shape.

3. Dry transformer according to claim 1, comprising:

ribs and/or fins, on a surface of the at least one wall-like diaphragm.

4. Dry transformer according to claim 1, wherein the at least one wall-like diaphragm has a convex shape, which is adapted to an outer shape of neighboring coils.

5. Dry transformer according to claim 1, wherein the at least one wall-like diaphragm is made at least in part from a metal.

6. Dry transformer according to claim 1, wherein the at least one wall-like diaphragm is made at least in part from a dielectric material.

7. Dry transformer according to claim 1, comprising:

a thermoconducting connection between the at least one wall-like diaphragm and at least one part of the transformer core.

8. Dry transformer according to claim 7, wherein the thermoconducting connection comprises:

slitted sleeves surrounding a yoke.

9. Dry transformer according to claim 1, wherein the wall-like diaphragms have a height, which corresponds to at least an axial height of the cylindrical coils.

10. Dry transformer according to claim 1, wherein the cylindrical coils and the wall-like diaphragms are oriented vertically.

11. Dry transformer according to claim 1, wherein the wall-like diaphragms are heat absorbing and are black in color.

12. Dry transformer according to claim 1, wherein the wall-like diaphragms are made of a material having thermoconducting characteristics.

13. Dry transformer according to claim 1, wherein the at least three parallel limbs are three limbs configured in a triangular shape, and the wall-like diaphragms are three symmetrically arranged wall-like diaphragms, which are arranged at an angle of 120 degrees to one another.

14. Dry transformer, comprising:

a transformer core with three parallel limbs and belonging upper and lower yokes, wherein the parallel limbs are arranged triangular around a virtual center axis parallel thereto;

three hollow cylindrical coils, each of the three hollow cylindrical coils arranged around a limb;

a cooling system comprising a wall-like diaphragm in between each neighbored coils, which is in parallel to the orientation of the limbs, wherein the wall-like diaphragms form guide plates for an additional natural air flow; and wherein the wall-like diaphragms are elongated in direction of the virtual center axis and arranged in a star-like arrangement, and wherein the star-like cooling arrangement comprises:

a chimney around the virtual center axis, which forms an inner cooling channel.

15. Dry transformer according to claim 14, wherein the wall-like diaphragms have a height, which corresponds to at least an axial height of the cylindrical coils.

16. Dry transformer according to claim 14, wherein the cylindrical coils and the wall-like diaphragms are oriented vertically.

17. Dry transformer according to claim 14, wherein the wall-like diaphragms are heat absorbing and are black in color.

18. Dry transformer according to claim 14, wherein the wall-like diaphragms are made of a material having thermoconducting characteristics.

19. Dry transformer according to claim 14, wherein the wall-like diaphragms are three symmetrically arranged wall-like diaphragms, which are arranged at an angle of 120 degrees to one another.

* * * * *